US006997752B2

(12) United States Patent
Kato et al.

(10) Patent No.: US 6,997,752 B2
(45) Date of Patent: Feb. 14, 2006

(54) CONNECTOR

(75) Inventors: Masato Kato, Kanagawa (JP); Hiroshi Fukuzaki, Kanagawa (JP); Tsuyoshi Fukami, Kanagawa (JP); Yoichi Kasamaru, Kanagawa (JP); Masaharu Takai, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/000,079

(22) Filed: Dec. 1, 2004

(65) Prior Publication Data

US 2005/0130506 A1 Jun. 16, 2005

(30) Foreign Application Priority Data

Dec. 1, 2003 (JP) ..... 2003-402294

(51) Int. Cl.
*H01R 24/00* (2006.01)

(52) U.S. Cl. ..... 439/637; 439/79

(58) Field of Classification Search ..... 439/630, 439/637, 79, 83

See application file for complete search history.

(56) References Cited

U.S. PATENT DOCUMENTS 5,160,275 A * 11/1992 Nakamura et al. ..... 439/328
5,277,596 A * 1/1994 Dixon ..... 439/79
5,415,573 A * 5/1995 Chen et al. ..... 439/876
5,709,555 A * 1/1998 Noschese ..... 439/79
5,860,815 A * 1/1999 Feldman et al. ..... 439/79

FOREIGN PATENT DOCUMENTS

| | | | |
|---|---|---|---|
| JP | 06-260228 | A | 9/1994 |
| JP | 07-230861 | A | 8/1995 |
| JP | 07-312243 | A | 11/1995 |
| JP | 10-134909 | A | 5/1998 |
| JP | 11-067386 | A | 3/1999 |

* cited by examiner

*Primary Examiner*—Briggitte R. Hammond
(74) *Attorney, Agent, or Firm*—Rader, Fishman & Grauer PLLC

(57) ABSTRACT

The present invention provides a connector capable of being easily and reliably coupled to a printed circuit board. A connector (10) comprises two sets of a plurality of lead parts (31) and a plurality of lead parts (41) extending from one side surface (11) of a housing (1) to be opposite to each other. A printed circuit board (20) includes slot (21) abutting on the side surfaces (11) to (13) of the housing (1), and edge connectors (22A) and (22B) are formed on both surfaces of an edge abutting on the one side surface (11). The edge connectors (22A) and (22B) are inserted between the lead parts (31) and (41), and the lead parts (31) and (41) are soldered to the edge connectors (22A) and (22B), respectively. In a pair of first protrusions (14A) and (15B), a recess (140) for gripping the printed circuit board (20) is formed, and the recess (140) is aligned in the same row as the opposing gap between the lead parts (31) and (41), The second protrusions (15A) and (15B) each have a supporting surface abutting on one surface of the printed circuit board (20), and respectively protrude from the side surfaces (12) and (13) arranged opposite to each other.

16 Claims, 7 Drawing Sheets

CONNECTOR

CROSS-REFERENCE TO RELATED APPLICATIONS

This application is based upon and claims the benefits of priorities from Japanese Patent Application No. 2003-402294 filed on Dec. 1, 2003, the entire contents of which are incorporated herein by reference.

This application is related to co-pending U.S. patent applications Ser. Nos. 11/000,031 and 11/000,078. The co-pending applications are expressly incorporated herein by reference.

FIELD OF THE INVENTION

The present invention relates to an electrically connectable connector. More specifically, the present invention relates to a straddle mount type connector in which a printed circuit board is interposed between contact lead parts extending to a rear portion of the connector such that the contact lead parts are electrically connected to the printed circuit board by soldering. The straddle mount type connector is a kind of surface mounting type connectors.

RELATED ART

With the development of a surface mount technology (SMT), it is possible to reduce the mounting stature of the connector for the printed circuit board and to realize a connector for a printed circuit board having a narrow pitch contactor.

The SMT is a technique in which, instead of through-hole mounting, lead parts overlap a contact pad (or land) formed on the printed circuit board and are soldered thereto using a soldering device such as a hot-air circulation reflow soldering device. In the straddle mount type connector manufactured by the SMT, the lead parts of the connector are soldered to an edge connector comprised of contact pads.

The straddle mount type connector has no sufficient mechanical coupling force because only the weak lead parts are soldered to the edge connector. Therefore, the connector housing is fixed to the printed circuit board using a fastener, such as a screw.

On the other hand, when the connector housing is reliably fixed to the printed circuit board using a fastener such as a screw, a trouble may occur in the electrical or mechanical connection relationship between the printed circuit board and the connector, or the assembly process of the connector and the printed circuit board may be difficult.

As a straddle mount type connector to solve such a problem, a single-sided straddle mount type connector for the printed circuit board is disclosed. In the single-sided straddle mount type connector, the connector is reliably fixed to the printed circuit board using a plurality of gripper arm assemblies arranged along a connector housing at a predetermined gap (see Japanese Patent Laid-Open No. 11-67386).

The above-mentioned straddle mount type connector is a connector to be mounted on the edge of the printed circuit board having a soldering pad on one surface thereof. The straddle mount type connector comprises an elongated insulating housing having a top wall part, an opposing lower wall part, and an edge wall part maintaining the gap between the top wall part and the opposing lower wall part, and a plurality of contacts arranged in at least one row which is held by the housing along an edge of the housing, each of the plurality of contacts comprising an end portion extending from the housing so as to electrically connected with an edge connector on the printed circuit board edge.

The above-mentioned straddle mount type connector further comprises a set of gripper arm and an intermediate protrusion. The set of gripper arm is formed together with the housing and extends from the housing to be adjacent to an edge portion of each of the plurality of contacts. Further, the set of gripper arm forms a space for receiving the printed circuit board together with a soldering end portion of the contact. The intermediate protrusion is integrally formed with the housing and extends form the housing at the intermediate position between the clipper and the arm.

Although the straddle mount type contact disclosed in Japanese Patent Laid-Open No. 11-67386 does not use a fastener, such as a screw, it is possible to reliably mechanically lock the printed circuit board to the connector, to overcome a drawback in that the connector is tilted, and to easily and simply perform an assembly process in manufacturing the connector and the printed circuit board.

However, in the straddle mount type contact disclosed in Japanese Patent Laid-Open No. 11-67386, it is necessary to insert the printed circuit board by aiming the board at the receiving space formed by the upper gripper arm and the lower gripper arm to avoid collision with the contacts.

In the memory card connector compatible with two types of memory cards, two sets of contact lead parts extend from one side surface of the corresponding housing so as to be opposite to each other and are soldered to the printed circuit board.

In the above-described straddle mount type connector for a memory card, even though a gripper arm assembly having the receiving space formed by the upper gripper arm and the lower gripper arm is arranged at the one side surface of the memory card connector, it is considerably difficult to insert and assemble the printed circuit board so as not to collide with the opposing contact lead parts.

In the straddle mount type connector, it is demanded a new holding structure in which the assembly of the connector and the printed circuit board can be easily performed without damaging the merits of the conventional gripper arm assembly and the connector and the printed circuit board can be reliably coupled to each other.

SUMMARY OF THE INVENTION

The present invention has been made to solve the above-mentioned situations, and an object of the present invention is to provide a straddle mount type connector in which an assembly of a connector and a printed circuit board is easily performed and which has a holding structure capable of reliably coupling the connector to the printed circuit board.

For the above-mentioned object, the present invertors have invented a straddle mount type connector having the following characteristics.

(1) In a first aspect of the present invention, a connector comprises a thin rectangular parallelepiped shaped insulating housing and two sets of lead parts being opposite to each other which extend from one side surface of the housing and are soldered to a printed circuit board. The printed circuit board has a rectangular slot, one of edge portions abutting on the one side surface of the housing and opposing two of the edge portions being adjacent to the one of the edge portions. On both surfaces at the one of the edge portions of the rectangular slot abutting on the one side surface, an edge connector is formed, and the both-surface edge connector is inserted between the lead parts opposite to each other, so that the lead parts and the edge connector are connected to each other by soldering. The connector further comprises a pair of first protrusions and a plurality of second protrusions. Each of the pair of first protrusions, being protruding from the one side surface, has a recess for gripping both surfaces of the printed circuit board. The recessed are arranged at both ends of the lead parts aligned in a line so as to be arranged in the same row as an opposing gap between two sets of lead parts. Each of the plurality of second protrusions, protruding from respective opposing side surfaces adjacent to the one side surface, has a supporting surface abutting on one surface of the two of the edge portions of the slot of the printed circuit board.

(2) In a second aspect of the present invention, there is provided a connector according to (1), wherein each of the pair of first protrusions comprises a recess for gripping the printed circuit board, a first extension part, and a second extension part being arranged opposite to each other across the recess. The first extension part having a surface defining the recess is arranged such that the supporting surfaces of the second protrusions are substantially flush with the surface of the first extension part, which extends farther than the second extension part.

(3) In a third aspect of the present invention, here is provided a connector according to (2), wherein the second extension part of each of the pair of first protrusions protrudes farther than the lead parts.

(4) In a fourth aspect of the present invention, there is provided a connector according to from (1) to (3), wherein the connector further comprises a plurality of connection tabs which extend in the opposite direction from a pair of side surfaces that is adjacent to the one surface of the housing and is opposite to each other. A bottom surface of each of the connection tabs is arranged on the same surface as the supporting surfaces of the plurality of second protrusions. The bottom surfaces of the plurality of connection tabs are soldered to the printed circuit board.

(5) In a fifth aspect of the present invention, there is provided a connector according to from (1) to (4), wherein the connector further comprises a plurality of first cantilever contacts connected to a first surface connection terminal of a first memory card and a plurality of second cantilever contacts connected to a second surface connection terminal of a second memory card. A fixed end of each of the first and second cantilever contacts is composed of two sets of lead parts which extend from the one side surface of the housing to be opposite to each other and are connected to the printed circuit board by soldering.

(6) In a sixth aspect of the present invention, there is provided a connector according to (5), wherein the first memory card includes an SD card.

(7) In a seventh aspect of the present invention, there is provided a connector according to (5), wherein the second memory card includes a memory stick card.

According to the first aspect of the present invention, a connector comprises a thin rectangular parallelepiped shaped insulating housing and two sets of lead parts which extend from one side surface of the housing to be opposite to each other and are soldered to a printed circuit board. The printed circuit board has a rectangular slot which abuts on the one side surface of the housing and a pair of side surfaces adjacent to the one side surface and opposite to each other. On both surfaces of an edge of the rectangular slot abutting on the one side surface, edge connectors are formed, and the both-sided edge connectors are inserted between the lead parts opposite to each other, so that the lead parts and the edge connectors are connected to each other by soldering, The connector further comprises a pair of first protrusions and a plurality of second protrusions. The pair of first protrusions each have a groove for gripping both surfaces of the printed circuit board and protrude from the one side surface. The grooves are arranged at both wings of the lead parts so as to be arranged in the same raw as an opposing gap between two sets of lead parts. The plurality of second protrusions each have a supporting surface abutting on one surface of the printed circuit board and protrude from a pair of side surfaces adjacent to the one side surface in the opposite direction.

The housing may be made of an insulating synthetic resin having a thin rectangular parallelepiped shape. Two sets of lead parts extend from the one side surface of the housing to be opposite to each other. End portions of the opposing lead parts may be bent so that the printed circuit board to be coupled by soldering can be easily interposed between the opposing lead parts.

The 'rectangular slot' abutting on the one side surface of the housing and the pair of opposing side surfaces adjacent to the one side surface may be a 'rectangular cut-out opening' slightly larger than the housing in size. The connector may be inserted into the slot in the direction parallel to the extension direction of the lead parts, or inserted into the slot in the direction perpendicular to the extension direction of the lead parts.

The first protrusions preferably have a square pillar shape. However, the first protrusions may be cylindrical protrusions, each of which has a rectangular recess to grip both the sides of the printed circuit board. The second protrusions also preferably have a square pillar shape. However, the second protrusion may have a semicircular shape whose supporting surface is flat, or a triangular prism shape whose supporting surface is flat.

The recesses formed in the pair of first protrusions arranged at both end portions of the lead parts aligned in a line may have rectangular shapes. A part of the printed circuit board may be inserted into the recess with relatively weak force in the plain direction, and both surfaces of the printed circuit board may be contacted and gripped by the recesses. The first extension part and the second extension part defining the recess may have elastic force to hold the printed circuit board.

As described above, in the connector according to the present invention, the edge of the printed circuit board is gripped by the pair of first protrusions. Further, both two side portions of the rectangular slot support the plurality of the second protrusions on the respective supporting surfaces. Therefore, the connector and the printed circuit board can be more reliably mechanically coupled to each other. The printed circuit board coupled to the connector can stand the external force applied to the plane of the connector.

According to the second aspect of the present invention, each of the paired first protrusions comprises a first extension part, a second extension part being arranged opposite to each other, and a recess being formed by the first extension part and the second extension part to grip the printed circuit board. The first extension part, which is arranged substantially in the same surface as the plurality of second protrusions are arranged such that one surface of the first extension part defining the recess is substantially flush with the supporting surfaces of the second protrusions, protrudes farther than the second extension part.

When the printed circuit board is attached to the connector, the printed circuit board is arranged so as to approach to the connector from the direction perpendicular to the extension direction of the lead parts. Then, after the peripheral of the rectangular slot of the printed circuit board abuts on the supporting surfaces of the plurality of the second protrusions and the recess-formed surfaces of the first extension parts, a part of the printed circuit board is inserted into the housing in the direction parallel to the extension direction of the lead parts while sliding on the supporting surfaces and the recess-formed surfaces.

That is, a step exists between the first extension part and the second extension part, and the printed circuit board moves along the step surface, such that it is possible to insert the printed circuit board without aiming the board in the conventional manner. Thus, the assembly can be easily performed.

According to the third aspect of the present invention, the second extension part of each of the pair of first protrusions protrudes farther than the lead parts.

The second extension part protrudes farther than the lead parts, and the first extension part also protrudes farther than the lead parts. Specifically, in a case in which the printed circuit board approaches the housing from the direction perpendicular to the extension direction of the lead parts, the pair of first protrusions arranged at both end portions of the lead parts aligned in a line protect the printed circuit board from colliding with the lead parts.

According to the fourth aspect of the present invention, the connector further comprises a plurality of connection tabs which extend in the opposite directions from a pair of side surfaces that are adjacent to the one surface of the housing and are opposite to each other. A bottom surface of each of the connection tabs is arranged on the same surface as the supporting surfaces of the plurality of second protrusions. The bottom surfaces of the plurality of connection tabs are soldered to the printed circuit board.

The connection tab may be a reinforcing tab. The connection tab press-inserted into the housing is soldered to a pad formed on the printed circuit board, such that the connector and the printed circuit board can be reliably mechanically coupled to each other.

According to the preferred embodiment of the present invention, the connector further comprises a plurality of first cantilever contacts connected to a first surface connection terminal of a first memory card and a plurality of second cantilever contacts connected to a second surface connection terminal of a second memory card. A fixed end of each of the first and second cantilever contacts is composed of two sets of lead parts which extend from the one side surface of the housing to be opposite to each other and are connected to the printed circuit board by soldering.

The cantilever contact is a plate spring contactor. By the performance of the plate spring, it functions as a cantilever contact. The plurality of cantilever contacts are aligned in the direction perpendicular to the memory card insertion direction.

The plurality of cantilever contacts are arranged at positions opposite to the card insertion slit to the card holding space. Specifically, the plurality of cantilever contacts are arranged at a stopping wall side to which the peripheral portion of the surface connection terminal arranged in the memory card is adjacent.

Further, the elastic portion of the cantilever contact is arranged opposite to the card insertion slit, and the end portion of the fixed portion of the cantilever contact constitutes a lead part extending toward the rear of the stopping wall and is coupled by soldering.

According to the preferred embodiment of the present invention, the first memory card may include an SD (Secure Digital) card, and the second memory card may include a memory stick card.

According to the present invention, in a straddle mount type connector, the edge of the printed circuit board is gripped by the pair of first protrusions, and both the wings of the rectangular slot are held by the plurality of second protrusions, such that the connector and the printed circuit board can be reliably mechanically coupled to each other.

Further, there exists a step between the first extension part and the second extension part of each of the pair of first protrusions, and the printed circuit board moves in parallel along the step surface, such that it is possible to insert a part of the printed circuit board without aiming in a conventional manner. Thus, it is possible to easily couple the connector to the printed circuit board.

Further, features of the invention, its nature, and various advantages will be more apparent from the accompanying drawings and the following detailed description of the invention.

DESCRIPTION OF THE PREFERRED EMBODIMENT

The preferred embodiment of the present invention will be described below in reference to the drawings. However, the present invention is not limited to the embodiment, and various modifications and changes in design can be made without departing from the scope of the present invention.

Figure 1A:
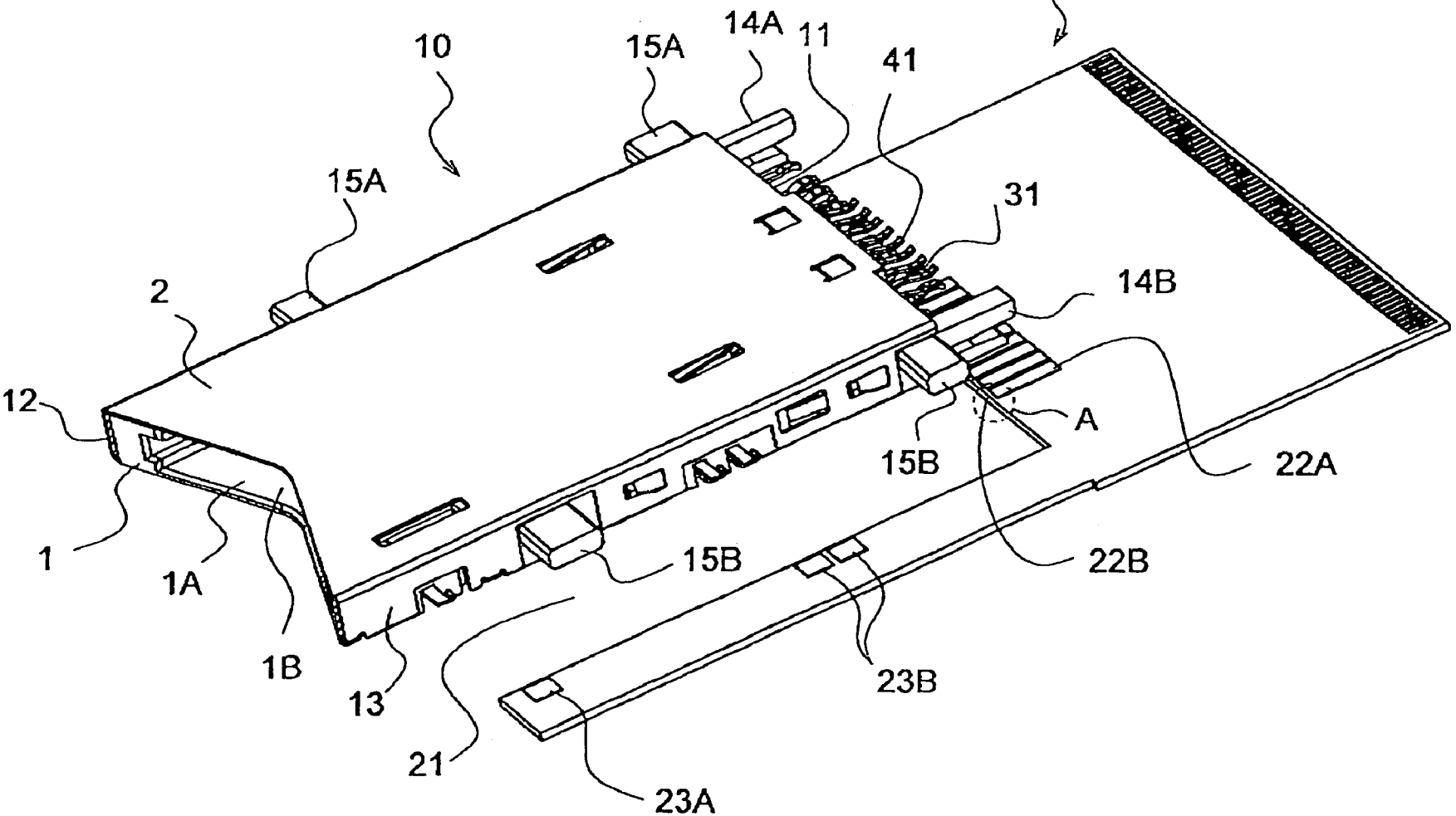
FIGS. 1A and 1B are external perspective views of a connector according to an embodiment of the present invention.
Figure 1B:
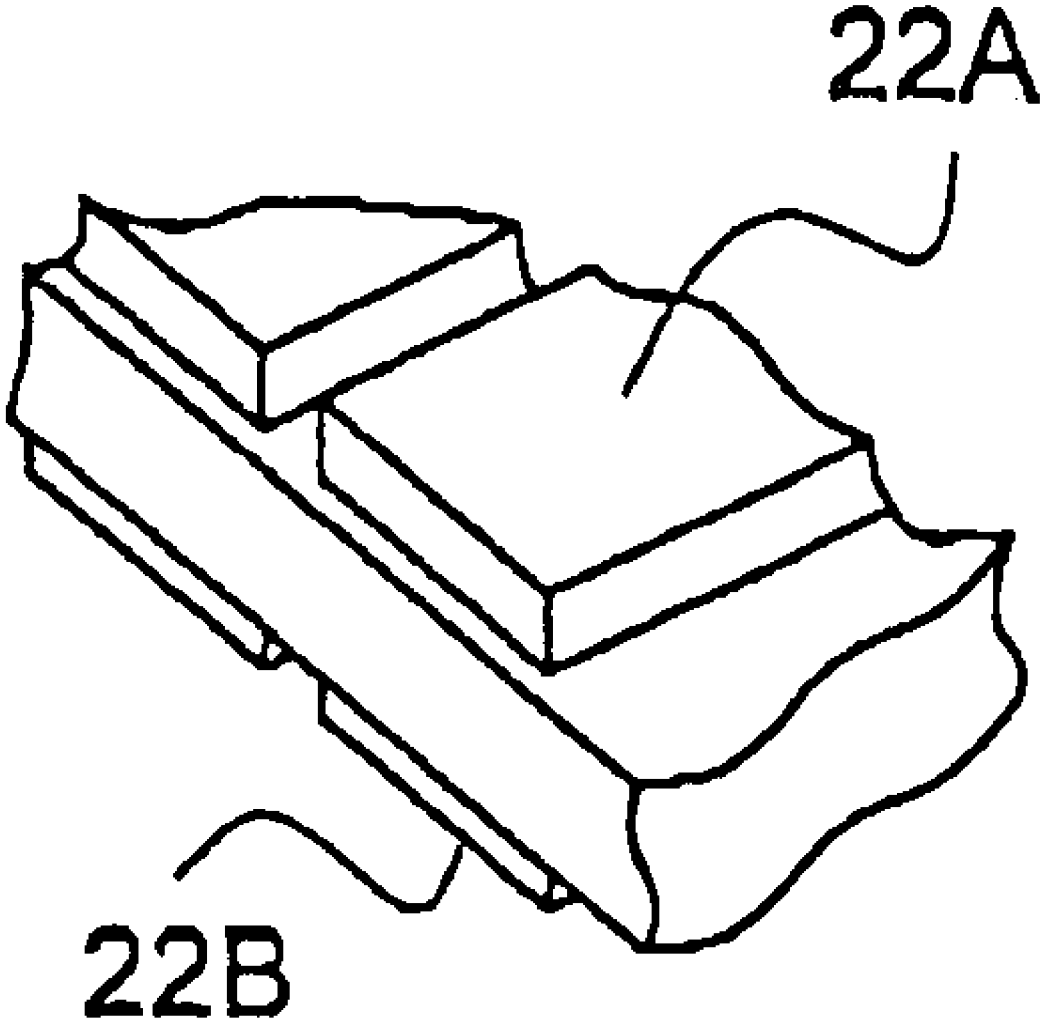

FIGS. 1A and 1B are perspective views showing the external appearance of a straddle mount type connector for a memory card (hereinafter, referred to as a connector) according to an embodiment of the present invention. In a connector 10 of FIG. 1A, reference numeral 1 designates a housing, reference numeral 2 designates a cover, and reference numeral 20 designates a printed circuit board on which the connector 10 is mounted.

In the embodiment of FIG. 1A, the housing 1 is made of an insulating synthetic resin with a rectangular shape. The cover 2 is composed of a metal plate, and both wings (side portions) thereof are bent in an 'L' shape. Further, the cover 2 is attached to the housing 1 so as to cover the housing 1.

Since the cover 2 is attached to the housing 1, a card insertion slot 1A through which an SD card or a memory stick card (not shown) is inserted and a card holding space 1B having a thin rectangular parallelepiped shape are formed in the connector 10.

A plurality of cantilever contacts 3, which will be described later, contacting a surface connecting terminal (not shown) of the SD card are arranged inside the housing 1 facing the card insertion slot 1A. The plurality of cantilever contacts 3 each include a lead part 31 extending from one side surface 11, which is opposite to the other side composed of the card insertion slot 1A, to be soldered to the printed circuit board 20.

Similarly, a plurality of cantilever contacts 4, which will be described later, contacting a surface contact terminal (not shown) of a memory stick card are arranged inside the housing 1 facing the card insertion slot 1A. The plurality of cantilever contacts 4 each include a lead part 41 extending from the one side surface 11, which is opposite to the other side composed of the card insertion slot 1A, and soldered to the printed circuit board 20.

In the embodiment of FIG. 1A, leading edges of the plurality of lead parts 31 and the plurality of lead parts 41 are bent so as to easily receive an edge of the printed circuit board 20. Further, the respective bent portions are arranged to be opposite to each other with predetermined apace so as to contact both surfaces of the printed circuit board 20, respectively.

The housing 1 includes a pair of side surfaces 12 and 13, being opposite to each other, adjacent to the one side surface 11. Further, in the embodiment of FIG. 1A, the side surfaces 12 and 13 are covered with the cover 2 by bending wings (side portions) thereof in an 'L' shape, respectively. However, the arrangement is not limited thereto. The side surfaces 12 and 13 may be formed as side surfaces of the housing 1.

On the other hand, in the printed circuit board 20, a slot 21, which is a rectangular shaped opening, is formed. The slot 21 is formed so that the connector 10 is inserted into the center thereof. Specifically, the side surfaces 12 and 13 of the connector 10 can be inserted into the slot 21 with a predetermined clearance in the width direction. Further, as will be described below, when the connector 10 moves in the right direction in the drawing, the one side surface 11 abuts on a right side edge of the slot 21 in the drawing. Further, edge connectors 22A and 22B are formed on the front surface and the rear surface of the edge of the rectangular slot 21 that abuts on the one side surface 11, respectively. In FIG. 1A, the edge connector 22B is covered by the edge connector 22A, such that it is not clearly shown. FIG. 1B is a partially enlarged view of FIG. 1A. The edge connector 22B is shown clearly in FIG. 1B.

In the embodiment shown in FIGS. 1A and 1B, the edge connectors 22A and 22B formed on both surfaces of the printed circuit board 20 are inserted between the lead parts 31 and 41 vertically arranged to be opposite to each other. Further, the upper lead part 41 is soldered to the edge connector 22A on the front surface of the printed circuit board. The lower lead part 31 is soldered to the edge connector 22B on the rear surface of the printed circuit board.

Figure 2:
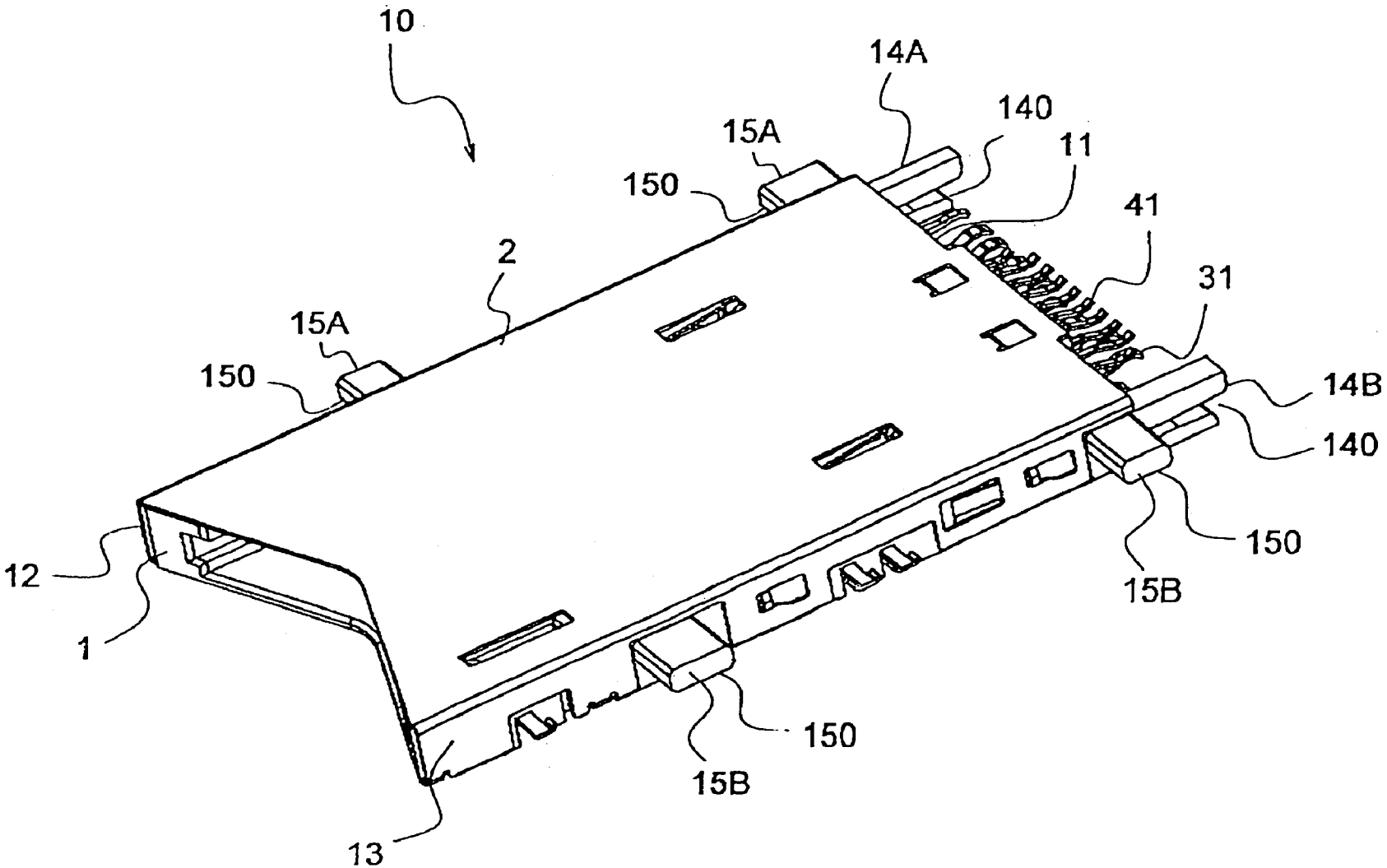
FIG. 2 is an external perspective view of the connector according to the present invention.

FIG. 2 is a perspective view illustrating the external appearance of the connector 10 according to the embodiment of the present invention. FIG. 2 shows only the connector 10. The configuration of the connector 10 shown in FIG. 2 will be described with reference to FIG. 1.

In the embodiment in FIG. 2, a pair of first protrusions 14A and 14B protrude from the one side surface 11 in the vicinities of the right and left sides of the connector 10 in FIG. 2. The pair of first protrusions 14A and 14B each have a recess 140 at the substantially center of the connector 10 in the vertically direction in FIG. 2, and the recess 140 holds or grips the both surfaces of the printed circuit board 20, The opposing gap formed by the plurality of upper lead parts 41 and the respective plurality of lower lead parts 31 in the drawing extends in the width direction of the connector 10 at the substantially central position of the thickness direction of the connector 10. The opposing gap extending in the width direction is formed substantially on the same plane as the recesses 140 of the first protrusions 14A and 14B are formed. Specifically, when it is seen through the recess 140 of the first protrusion 14B from the side surface 13 of the connector 10, it is possible to see the recess 140 of the first protrusion 14A through the opposing gap between the upper and lower lead parts 41 and 31. In the above-mentioned construction, the plurality of lead parts 31 and 41 are positioned in a line between the pair of first protrusions 14A and 14B.

Further, as shown in FIG. 2, a plurality of second protrusions 15A and 15B protrude from side surfaces 12 and 13 toward the outside, respectively. Specifically, the second protrusions 15A and 15B protrude from the left and right surfaces of the connector 10 in the opposite directions, respectively. Furthermore, each of the plurality of second protrusions 15A and 15B has a supporting surface 150, on which the surface of the printed circuit board 20 shown in FIG. 1 is abutted.

Figure 3C:
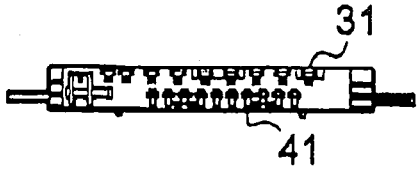
FIGS. 3A to 3E are views illustrating the structure of the connector according to the present invention.

Further, the construction of the connector 10 will be described with reference to FIGS. 3A to 3E. FIG. 3A is a plan view of the connector 10, and FIG. 3B is a front view of the connector 10. Further, FIG. 3C is a rear view of FIG. 3A, FIG. 3D is a right side view of FIG. 3A, and FIG. 3E is a left side view of FIG. 3A.

Figure 3E:
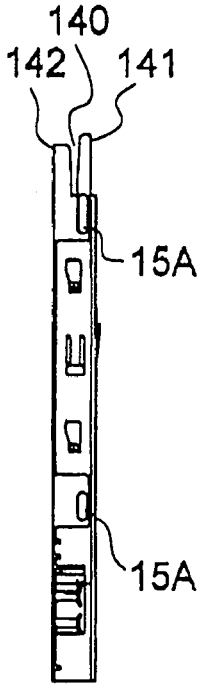
Figure 3A:
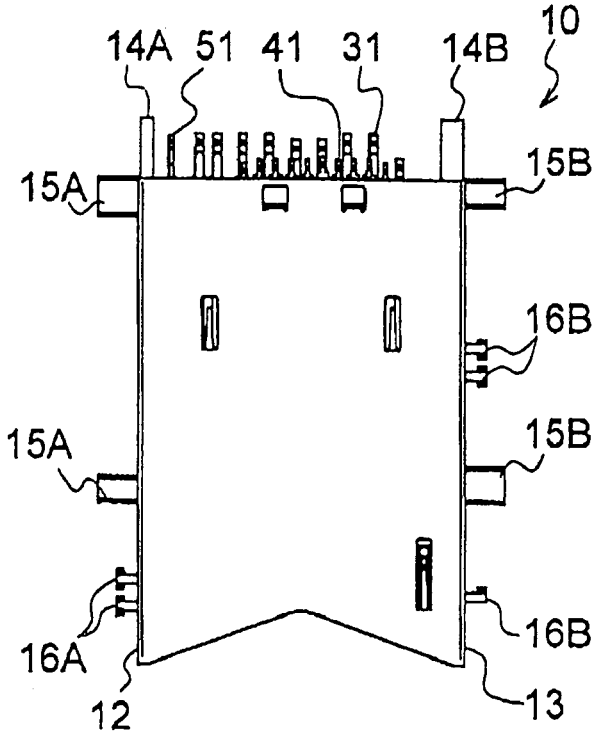
Figure 3D:
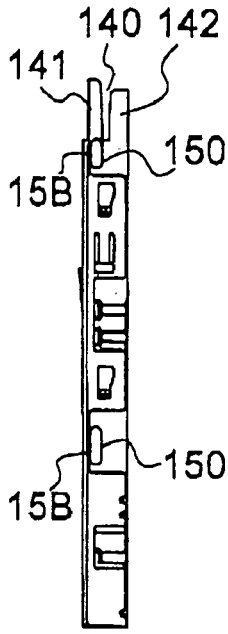
Figure 3B:
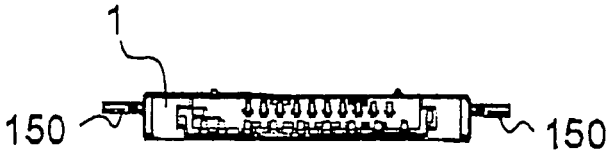

As clearly shown in FIGS. 3D and 3E, the pair of first protrusions 14A and 14B each comprise a first extension part 141 and a second extension part 142 arranged to be opposite to each other. Further, the recess 140 is formed between the first extension part 141 and the second extension part 142 to grip the printed circuit board 20 shown in FIG. 1A.

As shown in the embodiment in FIGS. 3A–E, the plurality of second protrusions 15A and 15B are arranged at the upper side in the thickness direction of the connector 10 with the supporting surface 150 thereof facing downward. The first extension part 141 is provided at the upper side so as to be in substantially the same position in the thickness direction of the connector 10 to the second protrusions 15A and 15B. On the other hand, the second extension part 142 is provided at the lower side of the drawing contrary to the first extension part. The recess 140 is provided substantially at the center in the thickness direction of the connector 10, Here, the first extension part 141 farther protrudes from the one side surface 11 than the second protrusion 142. That is, the extension length of the first extension part 141 is larger than that of the second extension part 142. Further, each second extension 142 of the pair of first protrusions 14A and 14B protrudes longer than the lead parts 31 and 41. Specifically, in FIG. 3A, the protrusion length or extension length is large in the order of the first extension part 141, the second extension part 142, the lead part 31, and the lead part 41.

Further, in the embodiment shown in FIG. 3, a plurality of connection tabs 16A and 16B extend toward the outside from the pair of side surfaces 12 and 13 provided on the housing 1. Specifically, the connection tabs 16A and 16B extend in the directions opposite to each other. In addition, the lower surfaces of the plurality of connection tabs 16A and 16B are arranged in the same plane as (flush with) the supporting surface 150 of each of the plurality of second protrusions 15A and 15B. The lower surfaces of the plurality of connection tabs 16A and 16B are soldered to pads 23A and 23B formed on the printed circuit board 20 shown in FIG. 1A.

Figure 4:
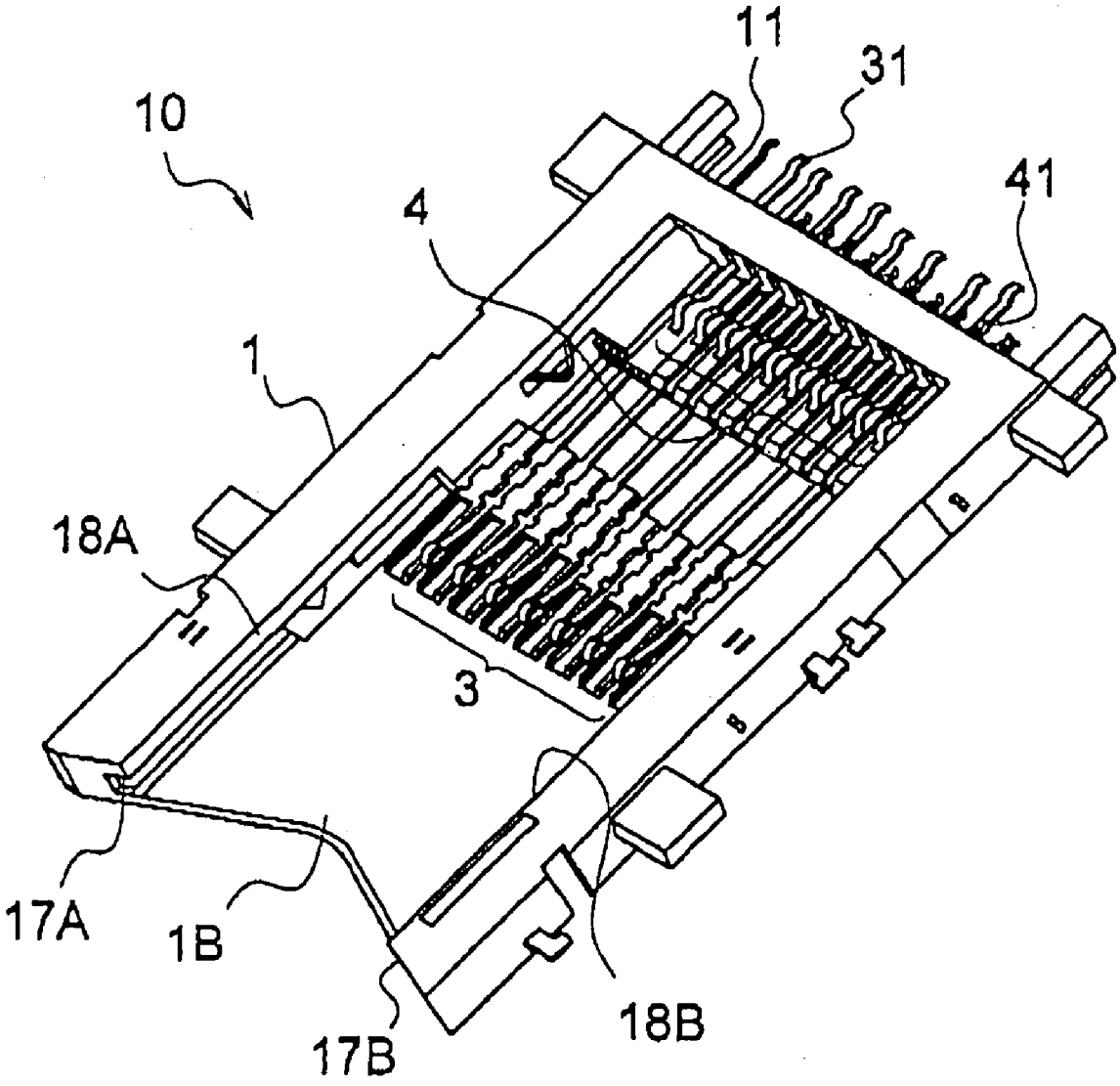
FIG. 4 is an external perspective view of the connector according to the present invention in a state in which a cover is removed.

FIG. 4 is a perspective view illustrating the external appearance of the connector 10 in a state in which the cover 2 shown in FIG. 2 is removed. As shown in the embodiment in FIG. 4, in a card holding part 1B having a thin rectangular parallelepiped shaped space, guide grooves 17A and 17B having a gap slightly wider than the transverse width of an SD card are formed opposite to each other. The transverse width of the SD card is regulated by the guide grooves 17A and 17B, such that it is possible to align the positions of surface connecting terminals (not shown) of the SD card with the positions of the plurality of cantilever contacts 3.

As shown in FIG. 4, the cantilever contact 3 is a plate spring contactor. By the performance of the plate spring, it functions as a cantilever contact. The plurality of cantilever contacts 3 are aligned in a line parallel to the width direction of the SD card in the direction perpendicular to the SD card insertion direction.

Further, the card holding part 1B includes guide walls 18A and 18B opposite to each other with a gap slightly wider than the transverse width of the memory stick card. The transverse width of the memory stick card is regulated by the guide walls 18A and 18B, such that it is possible to align the position of the surface connecting terminals (not shown) of the memory stick card with the positions of the plurality of cantilever contacts 4.

As shown in FIG. 4, a cantilever contact 4 is a plate spring contactor. By the performance of the plate spring, it functions as a cantilever contact. The plurality of cantilever contacts 4 are aligned parallel to the transverse width direction of the memory stick card in the direction perpendicular to the memory stick card insertion direction.

In the embodiment in FIG. 4, each fixed end of the cantilever contacts 3 and 4 extends from the one side surface 11 of the housing 1 in the direction opposite to the extension direction of the cantilever contacts 3 and 4. Further, extending ends respectively extending in the directions opposite to the cantilever contacts 3 and 4 are the lead parts 31 and 41 soldered to the printed circuit board 20 (see FIG. 1A).

Figure 5A:
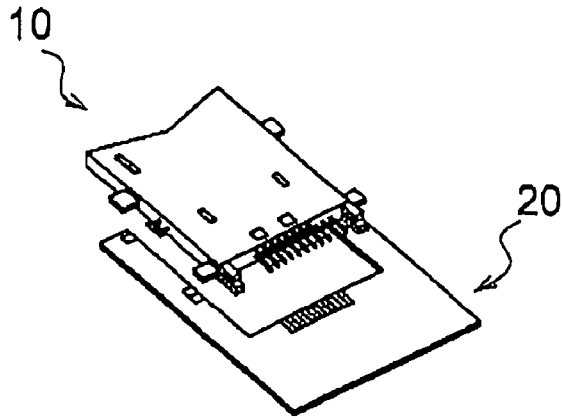
FIGS. 5A to 5C are flow diagrams showing the connector and a printed circuit board according to the present invention as perspective views, respectively.
Figure 5B:
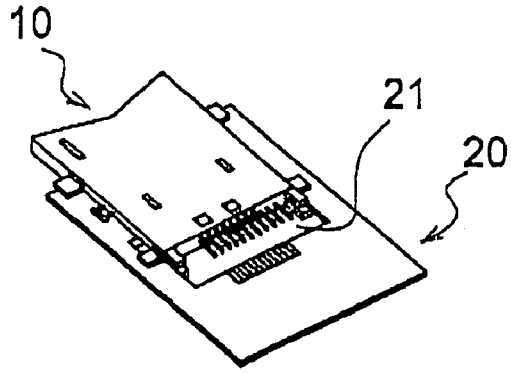
Figure 5C:
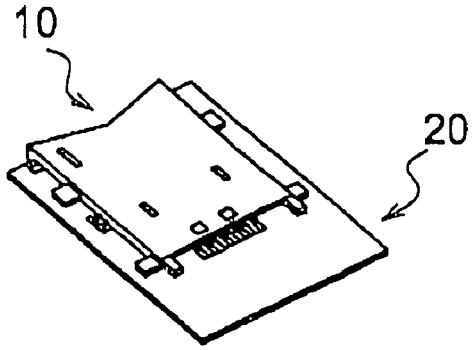

The operation of the present invention will now be described. FIGS. 5A to 5C are flow diagrams showing an assembly procedure of the connector 10 and the printed circuit board 20. The connector 10 and the printed circuit board 20 are shown in perspective view, respectively.

FIG. 5A is a view showing a state in which the connector 10 and the printed circuit board 20 are separated from each other. When the printed circuit board 20 is attached to the connector 10, the printed circuit board 20 is arranged so as to approach to the connector 10 from the direction perpendicular to the extension directions of the lead parts 31 and 41 (see FIG. 1A) (from the upper position in the drawing).

Further, the connector 10 and the printed circuit board 20 may be relatively approached to each other. That is, after the printed circuit board 20 is fixed, the connector 10 may approach the printed circuit board 20.

In FIG. 5B, the peripheral portion of the rectangular slot 21 of the printed circuit board 20 abuts on the supporting surfaces 150 of the plurality of second protrusions 15A and 15B shown in FIG. 2. From the state shown in FIG. 5B, the supporting surface 150 slides on the surface of the printed circuit board 20, and then the printed circuit board 20 is inserted into the recesses 140 shown in FIG. 2, which results in a state shown in FIG. 5C.

In FIG. 5C, the connector 10 is connected to the printed circuit board by gripping the edge end of the printed circuit board by the pair of first protrusions 14A and 14B (see FIG. 1A). Further, the connector 10 is supported by the plurality of second protrusions 15A and 15B on both sides of the rectangular slot 21, respectively (see FIG. 1A).

As described above, according to the present invention, a connector comprises a first protrusion having a recess for gripping a printed circuit board and a second protrusion by which the connector is supported on the printed circuit board. Therefore, it is possible that the connector and the printed circuit board are more reliably mechanically coupled to each other. Further, the connector-mounted printed circuit board can be more endurable against the external force applied in the plain surface of the connector.

Figure 6A:
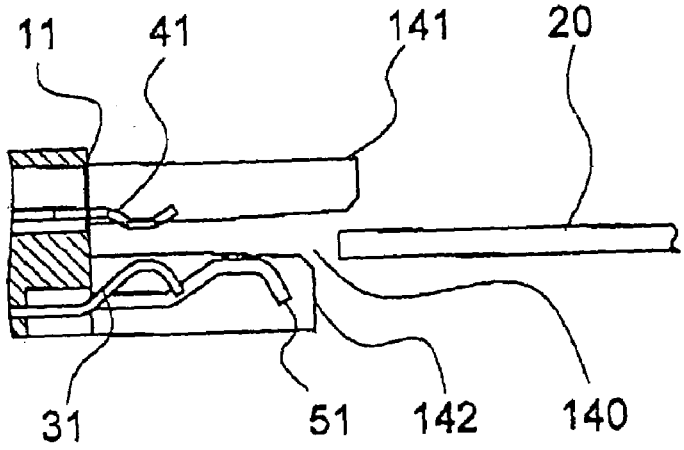
FIGS. 6A to 6C are longitudinal sectional views illustrating a part of the connector according to the present invention.
Figure 6B:
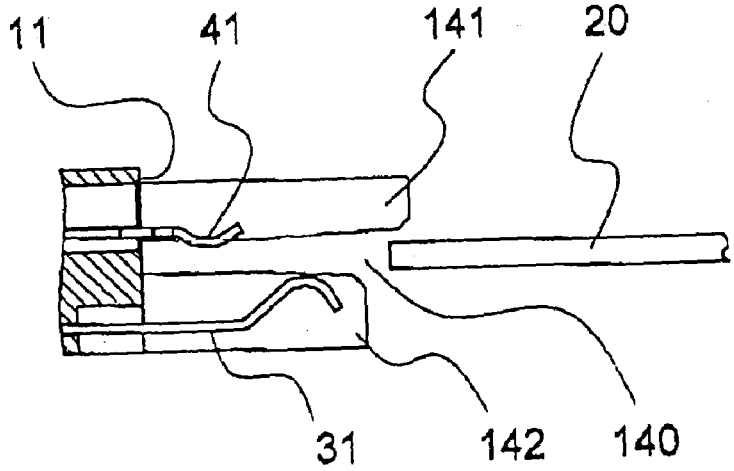
Figure 6C:
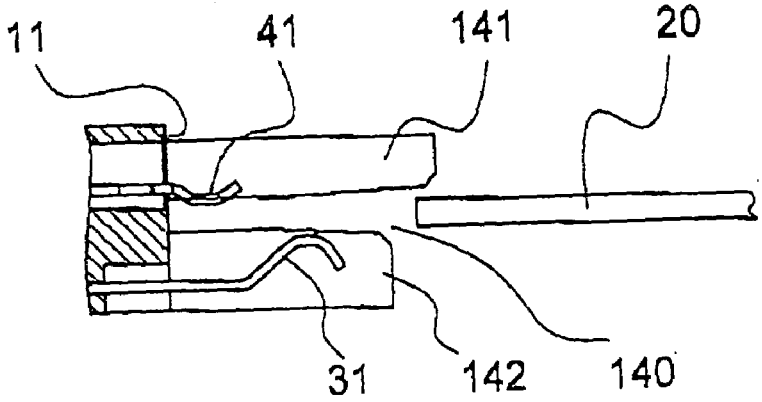

FIGS. 6A to 6C are partially longitudinal sectional views of FIG. 3. As shown in FIGS. 6A to 6C, the extension lengths of the lead parts 31 and 41 protruding from the one side surface 11 may be different from each other. Further, a lead part 51 shown in FIG. 6A extends form a plate spring of a card detecting switch.

Further, as shown in FIGS. 6A to 6C, none of the lead parts 31, 41, and 51 protrude farther than the first extension part 141 or the second extension part 142. Therefore, in the assembly process shown in FIGS. 5A and 5B, before the first extension part 141 or second extension part 142 contacts or nearly contacts the peripheral portion or edge of the slot 21, none of the lead parts 31, 41, and 51 contact thereto. Since the lead parts 31, 41 and 51 are protected by the first extension part 141 or the second extension part 142 in this manner, there is little possibility that the lead parts 31, 41 and 51 will be damaged.

Further, as shown in the embodiments of FIGS. 6A to 6C, the extension lengths of the first extension part 141 and the second extension part 142 are different from each other so as to form a step therebetween. Specifically, in the assembly process shown in FIGS. 5B and 5C, right before the recess 140 grips the printed circuit board 20, the recess 140 can guide the printed circuit board 20 with the surface of the longer first extension part 141 as the printed circuit board 20 moves into the recess. Therefore, it is easier to assemble them, if compared to the prior art, since it is not needed to insert the printed circuit board 20 by aiming the opposing gap between the lead parts 41 and 31 at the edge of the printed circuit board 20.

In the connector according to the present invention, a low stature type connector for a memory card that may be used in common to an SD card and a memory stick card is implemented as a straddle mount type. However, the connector may be compatible with other memory cards.

Further, the connector according to the present invention is exemplified as a straddle mount type connector in which two sets of cantilever contact lead parts are soldered to a printed circuit board. However, the connector according to the present invention may be a dual inline type connector, into or from which a printed circuit board is inserted or removed, as a straddle mount type connector that may be applied to the present invention.

What is claimed is:

1. A connector comprising:

a thin rectangular parallelepiped shaped insulating housing and two sets of lead parts extending from one side surface of the housing and being opposite to each other and being soldered to a printed circuit board, wherein the printed circuit board comprises a rectangular slot abutting on the one side surface of the housing and a pair of opposing side surfaces adjoining the one side surface of the housing; and an edge connector formed on both surfaces of an edge portion of the rectangular slot, on which the one side surface of the housing abuts, wherein the double-face edge connector is inserted between the lead parts being opposite to each other such that the lead parts and the edge connector are connected with solder, the connector further comprising:

a pair of first protrusions, each of which comprises a recess for holding both surfaces of the printed circuit board, protruding from the one side surface of the housing and being disposed at both end positions of the lead parts such that an opposing gap between the two sets of lead parts is aligned with the recess of each of the pair of first protrusions; and a plurality of second protrusions having supporting surfaces abutting on either surface of the printed circuit board and protruding in opposing directions from the pair of opposing side surfaces adjoining the one side surface of the housing, respectively.

2. The connector according to claim 1, wherein each of the pair of first protrusions comprises a first extension part, a second extension part being provided opposite to the first extension part, and a recess being defined by the first extension part and the second extension part such that the recess holds both surfaces of the printed circuit board; and wherein the first extension part, which is positioned on a same side of the housing in a thickness direction as the second protrusions, protrudes farther than the second extension part.

3. The connector according to claim 2, further comprising: a plurality of connection tabs extending in opposing directions from the pair of side surfaces adjoining to the one side surface of the housing, wherein bottom surfaces of the connection tabs are arranged to be flush with the supporting surfaces of the plurality of second protrusions and are soldered to the printed circuit board.

4. The connector according to claim 2, further comprising:

a plurality of first cantilever contacts to be connected to a first surface connection terminal of a first memory card; and a plurality of second cantilever contacts to be connected to a second surface connection terminal of a second memory card, wherein fixed end portions of the first and second cantilever contacts comprise soldered two sets of lead parts extending from the one side surface of the housing in an opposite direction.

5. The connector according to claim 2, wherein the second extension part of the each of the pair of first protrusions extends farther than the lead parts.

6. The connector according to claim 5, further comprising: a plurality of connection tabs extending in opposing directions from the pair of side surfaces adjoining to the one side surface of the housing, wherein bottom surfaces of the connection tabs are arranged to be flush with the supporting surfaces of the plurality of second protrusions and are soldered to the printed circuit board.

7. The connector according to claim 3, further comprising:

a plurality of first cantilever contacts to be connected to a first surface connection terminal of a first memory card; and a plurality of second cantilever contacts to be connected to a second surface connection terminal of a second memory card, wherein fixed end portions of the first and second cantilever contacts comprise soldered two sets of lead parts extending from the one side surface of the housing in an opposite direction.

8. The connector according to claim 1, further comprising: a plurality of connection tabs extending in opposing directions from the pair of side surfaces adjoining to the one side surface of the housing, wherein bottom surfaces of the connection tabs are arranged to be flush with the supporting surfaces of the plurality of second protrusions and are soldered to the printed circuit board.

9. The connector according to claim 8, further comprising:

a plurality of first cantilever contacts to be connected to a first surface connection terminal of a first memory card; and a plurality of second cantilever contacts to be connected to a second surface connection terminal of a second memory card, wherein fixed end portions of the first and second cantilever contacts comprise soldered two sets of lead parts extending from the one side surface of the housing in an opposite direction.

10. The connector according to claim 1, further comprising:

a plurality of first cantilever contacts to be connected to a first surface connection terminal of a first memory card; and a plurality of second cantilever contacts to be connected to a second surface connection terminal of a second memory card, wherein fixed end portions of the first and second cantilever contacts comprise soldered two sets of lead parts extending from the one side surface of the housing in an opposite direction.

11. The connector according to claim 10, wherein the first memory card comprises an SD card.

12. The connector according to claim 10, wherein the second memory card comprises a memory stick card.

13. A connector of a thin rectangular shape having a first side surface and opposing bilateral side surfaces adjoining to the first side surface, comprising:

a first lead part extending from the first side surface;

a second lead part extending from the first side surface and being opposite to the first lead part with a predetermined distance, wherein an opposing gap with the predetermined distance is formed between the first and the second lead parts;

a first protrusion protruding from the first side surface, the first protrusion comprising a recess forming a space communicating with the opposing gap in a lateral direction, the recess being open toward a protruding direction of the first protrusion; and a second protrusion protruding from either or both of the bilateral side faces of the housing, wherein the first protrusion comprises: a first extension part corresponding to the first lead part and a second extension part corresponding to the second lead part and the first and second extension parts define the recess;

wherein the connector utilizes the first extrusion and the second protrusion comprising a supporting surface such that an edge connector is inserted into the space in the recess and directed into the opposing gap between the first lead part and the second lead part.

14. The connector according to claim 13, wherein the first extension part has a longer extension length than the second extension part.

15. The connector according to claim 13, wherein the second extension has a longer extension length than the first lead part and the second lead part.

16. The connector according to claim 13, further comprising a connection tab extending outwardly from either or both of the bilateral side faces of the housing, wherein a bottom surface of the connection tab is provided such as the bottom surface is flush with the supporting surface.

* * * * *